United States Patent [19]

Elliott et al.

[11] Patent Number: 4,780,693

[45] Date of Patent: Oct. 25, 1988

[54] PROBE COUPLED WAVEGUIDE MULTIPLEXER

[75] Inventors: Joseph A. Elliott, Los Angeles; Rolf Kich, Redondo Beach, both of Calif.

[73] Assignee: Hughes Aircraft Company, Los Angeles, Calif.

[21] Appl. No.: 929,459

[22] Filed: Nov. 12, 1986

[51] Int. Cl.[4] ..... H01P 1/207; H01P 1/213

[52] U.S. Cl. ..... 333/135; 333/208; 333/212; 333/248

[58] Field of Search ..... 333/126, 135, 137, 208–212, 333/230, 248, 132, 134, 110, 113; 370/37, 38, 69.1, 72, 112, 123

[56] References Cited

U.S. PATENT DOCUMENTS

| | | | |
|---|---|---|---|
| 2,566,386 | 9/1951 | Varian | 333/110 |
| 2,626,990 | 1/1953 | Pierce | 333/126 |
| 2,686,902 | 8/1954 | Tillotson | 333/212 X |
| 2,795,763 | 6/1957 | Tillotson | 333/208 |
| 2,852,752 | 9/1958 | McCreary | 333/113 X |
| 4,453,146 | 6/1984 | Fiedziuszko | 333/212 |
| 4,614,920 | 9/1986 | Tong | 333/135 |

FOREIGN PATENT DOCUMENTS

| | | | |
|---|---|---|---|
| 0046701 | 3/1983 | Japan | 333/202 |
| 811662 | 4/1959 | United Kingdom . | |

OTHER PUBLICATIONS

Microwave Journal, vol. 8, No. 3, Mar. 1965, Horizon House, (Dedham, U.S.), R. J. Mohr: "New Coaxial Variable Attenuators", pp. 99–102, see pp. 101 and 102, paragraph "Zero Loss Cutoff Attenuator", FIG. 11.

*Primary Examiner*—Marvin L. Nussbaum

*Attorney, Agent, or Firm*—S. M. Mitchell; M. J. Meltzer; A. W. Karambelas

[57] ABSTRACT

A probe coupled waveguide multiplexer is provided including a first waveguide which serves as a multiplexing manifold; a second waveguide, having a cavity, typically a filter, which is probe coupled to the first waveguide; and a third waveguide which has a cavity and is probe coupled to the first waveguide such that the probe of said third waveguide is diametrically opposed to the probe of said second waveguide and the second and third waveguides are mounted in the same transverse plane in co-planar relation. The probe coupling method and apparatus disclosed herein allows the waveguide filters to be mounted on the manifold in a close physical relation thereby minimizing the length of the manifold and associated costs.

2 Claims, 3 Drawing Sheets

FIG. 1
RELATED ART
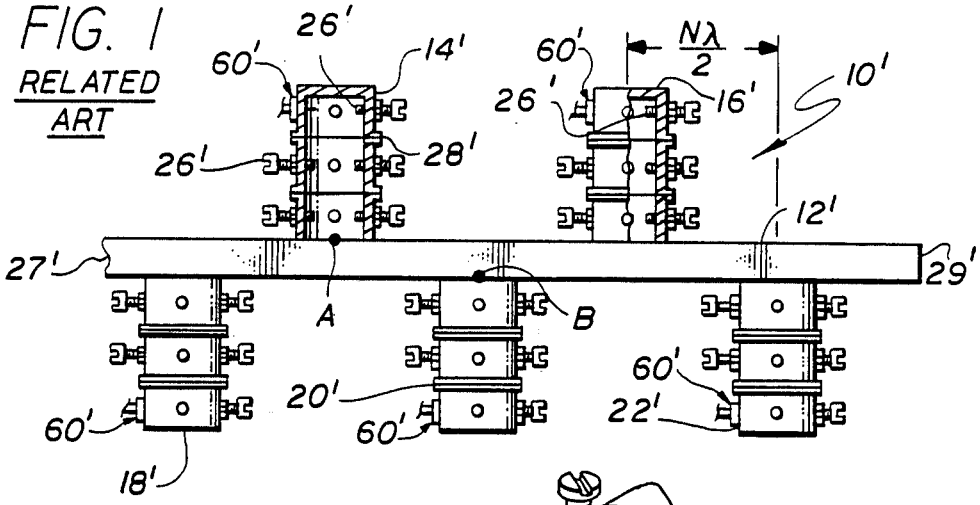
FIG. 2
RELATED ART
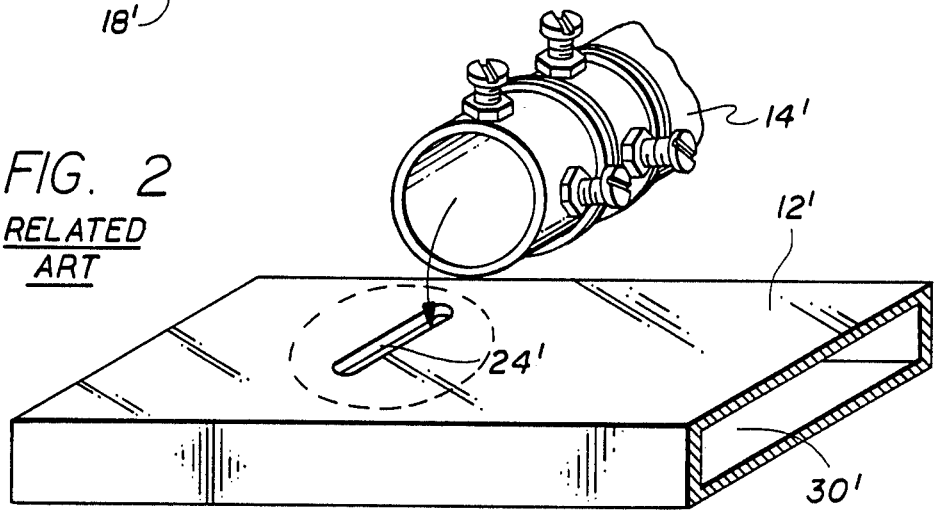
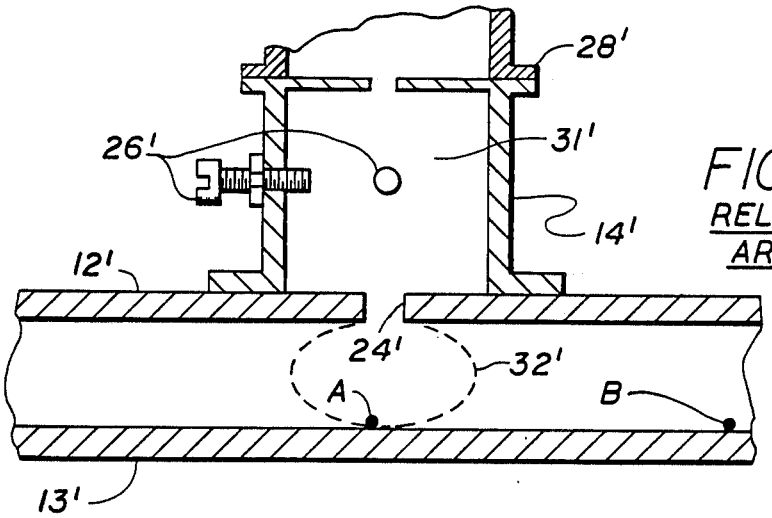
FIG. 3
RELATED ART

PROBE COUPLED WAVEGUIDE MULTIPLEXER

BACKGROUND OF THE INVENTION

1. Technical Field

The present invention relates to microwave circuits. More specifically, the present invention relates to multiplexers used to combine signals from two or more microwave channels.

While the present invention is described herein with reference to a particular embodiment in an illustrative application, it is understood that the invention is not limited thereto. Those having ordinary skill in the art and access to the teachings of the present invention will recognize additional modifications and applications within the scope thereof.

2. Description of the Related Art

In microwave communication systems, it is not uncommon to transmit or receive several channels of voice or data through a single antenna feed. In such systems, each channel provides a separate communications link. It is highly desirable therefore to minimize cross coupling between the channels. To do so, many systems individually amplify and filter each channel prior to multiplexing the channels into the single feed via a waveguide multiplexer. Waveguide multiplexers usually consist of a common microwave waveguide (manifold) into which the several channels are slot coupled. (See FIG. 1.) For example, where filtering is desired prior to multiplexing, the channels are first input to a tuned cavity or resonant filter via a conventional coaxial line or slot (iris). Each filter is connected at its output end to a rectangular waveguide manifold via a slot in the broad wall, for example, resulting in a series connected multiplexer. FIGS. 1 and 2 illustrate this particular connection arrangement. Unfortunately, as shown in the radiation pattern of FIG. 3, the top wall slots strongly radiate and couple in the broadside direction. This forces a design constraint using the teachings of the related art. That is, the coupling of the slots in the broadside direction prevents two filters from being located in the same plane (one coupling through a slot in the top wall, while the other couples through a slot directly opposite in the bottom wall) as the mutual inteference therebetween would be maximum. Further, any slot represents a discontinuity which perturbs the fields, causing higher order modes. Two or more such discontinuities in close proximity can result in resonances and destructive interactions adversely affecting the performance of each filter. It is common practice therefore to separate, when possible, such discontinuities by a minimum of one quarter wavelength. This allows for a sufficient distance within which the higher order modes may attenuate. Thus, the next series connected node is typically one-half wavelength in distance down the manifold in accordance with the practice in the art of spacing multiplexer filters at half wavelength intervals.

Although the slot coupled designs have been used successfully for some time, the increasing demands of modern microwave communication systems has posed numerous problems. That is, modern systems require more and more communications channels. As the number of channels increases, however, the number of filters increases. Because of the need to space the filters, the increase in channels results in an increase in the length of the manifold. As the manifold is typically made of a conductor (eg. aluminum), an increase in length is accompanied by an increase in weight and associated cost. This is particularly true in regards to satellite communications systems.

Longer manifolds also create greater insertion losses, ie., those losses associated with the insertion of a component in a transmission line.

In addition to weight and insertion loss problems, those of skill in the art have observed that as the manifold lengthens, it becomes more susceptible to undersirable interfering resonances in the passband resulting from mutual coupling of the several slots.

Yet another problem results from the fact that the increased distance between filters causes the respective out-of-band impedances to become dispersed. Dispersion can result in performance degradation.

Longer manifolds are therefore more sensitive and difficult to tune. Finally, longer manifolds are more susceptible to performance degradations due to mechanical flexures.

It is generally desirable therefore to minimize the length of the multiplexer manifold.

SUMMARY

The shortcomings demonstrated by the related art are substantially addressed by the probe coupled waveguide multiplexer of the present invention. As shown and disclosed herein, the waveguide multiplexer includes a first waveguide which serves as the multiplexing manifold. A second waveguide, typically a filter, is probe coupled to the first waveguide. A third waveguide is probe coupled to the first waveguide such that the probe of said third waveguide is diametrically opposed to the probe of said second waveguide.

The radiation pattern associated with the probe coupled design of the present invention is substantially different from that of the slot coupled design of the related art. Whereas the slot couples maximally in the direction of the opposite wall, the probe coupled radiation pattern is rotated 90 degrees and is a maximum longitudinally along the length of the manifold. A radiation null exists in the broadside direction which reduces the strength of the higher order modes in the broadside direction. A substantial reduction in mutual coupling can be achieved permitting two filters to be located directly opposite each other with minimal interference. The total manifold length can be made approximately one half that required by the design of the related art.

BRIEF DESCRIPTION OF THE DRAWINGS

FIG. 1 shows a multiplexer constructed in accordance with the teaching of the related art.

FIG. 2 is a detail view of the filter/manifold slot coupling arrangement of a multiplexer constructed in accordance with the teachings of the related art.

FIG. 3 is a sectional side view of the filter/manifold slot coupling arrangement of a multiplexer constructed in accordance with teaching of the related art.

DESCRIPTION OF THE INVENTION

Figure 4:
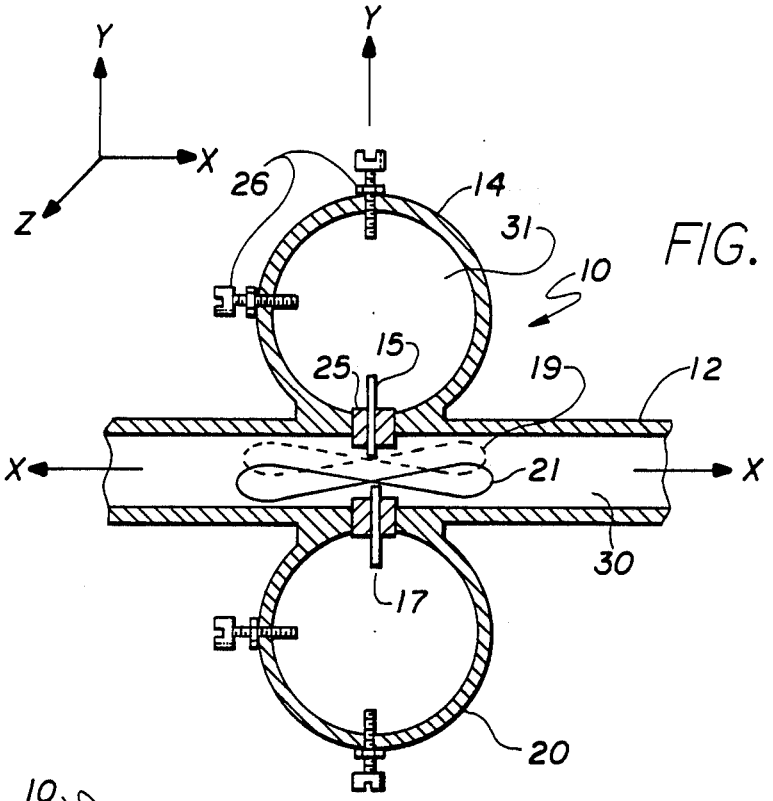
FIG. 4 is a sectional side view of a probe coupled waveguide constructed in accordance with the teachings of the present invention.

The present invention is most clearly described by first reviewing the slot coupled multiplexer design of the related art. FIG. 1 shows a typical multiplexer 10' constructed in accordance with the teachings of the related art. It includes a elongate manifold 12' to which a plurality of filters 14', 16', 18', 20', and 22' are slot coupled along the broadwall for series coupling at half wavelength intervals. The manifold 12' is typically made of aluminum or other suitably conductive material. The filters 14', 16', 18', 20', and 22' are typically rectangular, square, or circular housings each of which has a multiplicity of cavities 31' which are tuned to resonate at a particular frequency. The filters are interconnected by flanges 28'. One filter 14' is shown in section and a second filter 16' is shown in quarter section to illustrate the exterior and interior construction of the filters 14', 16', 18', 20', and 22'.

A plurality of tuning screws 26' are shown as one method of providing frequency adjustment to the filters 14', 16', 18', 20', and 22' and thereby to the multiplexer 10'. Energy is usually coupled to and from the filters via coaxial connector probes 60'. Slots are often used for this purpose as well. In FIG. 1, the open end of the manifold 27' is designated as an output. The opposite end 29' is typically a short circuit. The short circuit provides for a standing wave within the filter region of the manifold and allows for the connection of multiple filters at each open circuit or, in the example shown, short circuit node.

Note the spacing of the filters 14', 16', 18', 20', and 22' along the manifold 12' as multiples of half wavelengths. The spacing requires a longer manifold and is necessitated by the potential for destructive interaction of the slots 24'. The slot coupling arrangement of the related art is illustrated in the partial sectional perspective view of FIG. 2 where the manifold 12' is shown with a filter 14' rotated 90 degrees clockwise from its nominal position. The slot 24' is cut in the manifold 12' and acts to couple energy from the filter 14' into the manifold interior 30', or visa versa. The remaining slots similarly, couple energy from the corresponding filter into and/or out of the manifold interior.

The design of the manifold 12' is optimized to conduct certain fundamental modes of propagation along its length without substantial attenuation. Accordingly, nonfundamental or higher-order modes experience significant attenuation. For this reason, higher order modes are not typically present at the output of the multiplexer. Unfortunately, as illustrated in the radiation pattern 32' of the sectional side view of FIG. 3, the higher order modes generated at each slot, or discontinuity, 24' couple strongly to the opposing wall 13' in the area of point A in the immediate vicinity of the slot. To avoid the interference caused by these higher order modes, the next filter must be located at the next standing wave node; which, in this case, is the next short circuit point down the manifold 12' from point A eg., point B. For the same reason, subsequent filters must be so located with respect to each other. They may all be on the same wall unless there are mechanical reasons for placing them on opposite sides of the manifold 12'. Thus, the length of the multiplexer manifold is set according to the teachings of the related art.

FIG. 4 shows a corresponding sectional side view of a probe coupled multiplexer 10 utilizing the teachings of the present invention. It includes a manifold 12 having a longitudinal axis x—x and a plurality of transverse axes y—y. Two filters 14 and 20 are shown in co-planar relation along a common transverse axis y—y of the manifold 12. The manifold 12 and the filters 14 and 20 are essentially the same as those 12', 14', 18', 20', and 22' of the related art with the exception that the filters 14 and 20 are coupled to the manifold by probes 15 and 17 respectively. Note that the probe coupled design of the present invention allows the couplings of the filters 14 and 20 in the form of probes 15 and 17 to be readily mounted in collinear relation rather than at half wavelength intervals. This allows for a reduction in the overall length of the manifold by as much as 50% and also permits alternative mechanical arrangements to reduce the required shelf mounting space.

This co-planar connection of the filters is made possible by the radiation patterns 19 and 21 associated with probes 15 and 17 respectively. Note that each probe is suspended within an insulating bushing 25 and couples longitudinally along the x axis of the manifold 12 and not strongly to the opposing wall. Since no part of either probe is at ground potential, there is minimal capacitive coupling between probes as well. It should be noted that the patterns shown are for the purpose of illustration only. The actual radiation patterns may vary for each mode. For the purpose of the present invention, all that is required is that the coupling between probes 15 and 17 is weak resulting in minimal higher order mode interaction and inherent isolation.

The probes 15 and 17 are conductors which communicate microwave energy to and from the filter cavities 31 and the manifold waveguide 30. The probe size, shape and constraint of coupling are chosen in a manner known to those skilled in the art to provide the coupling value and loss value desired for a particular application.

Figure 5:
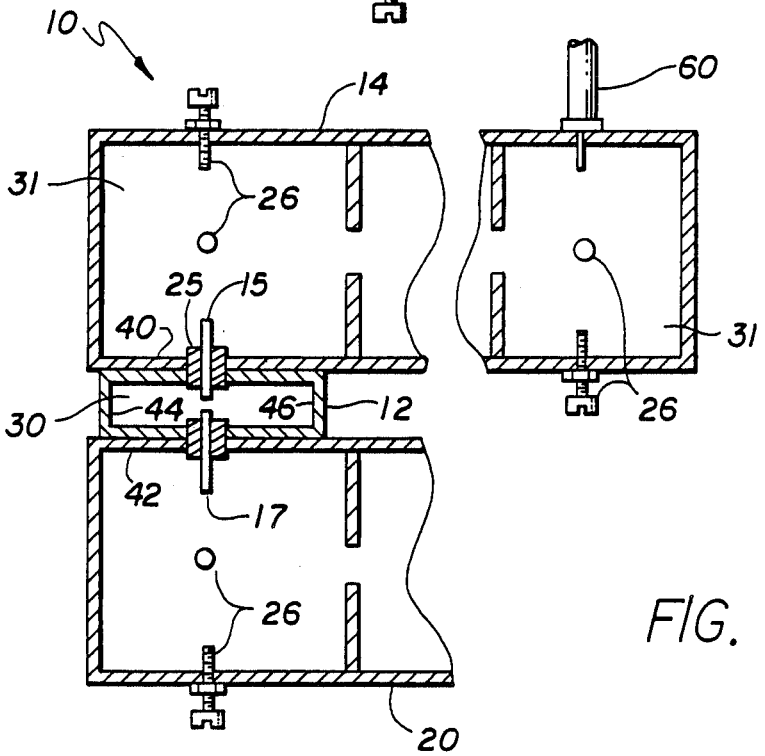
FIG. 5 is a sectional end view of a probe coupled waveguide constructed in accordance with the teachings of the present invention.
Figure 6:
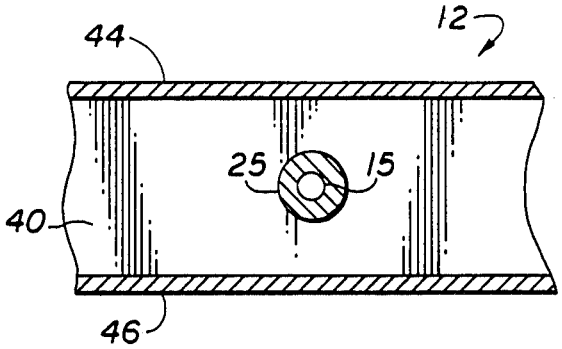
FIG. 6 is a partial sectional view of the manifold of FIG. 5.

The end view of FIG. 4 is provided by FIG. 5 which shows the top wall 40, bottom wall 42, and side walls 44 and 46 of the manifold 12 of a multiplexer 10 in one of the several mechanical filter arrangements made possible by the present invention. The sectional view of FIG. 6 shows the interior of the top wall 40 of the manifold 12 through which the probe 15 extends. The probe 15 is mounted concentrically within an insulator 25 to isolate it from the conductive wall 40 of the manifold 12.

Figure 7:
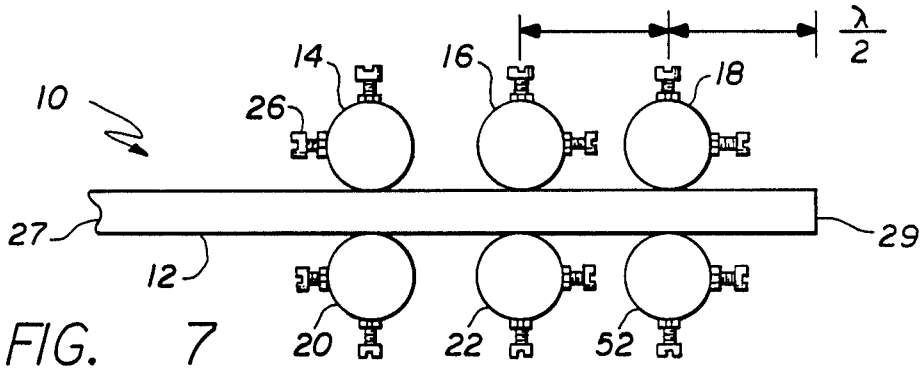
FIG. 7 shows a typical multiplexer configuration attainable with the teachings of the present invention.
Figure 8:
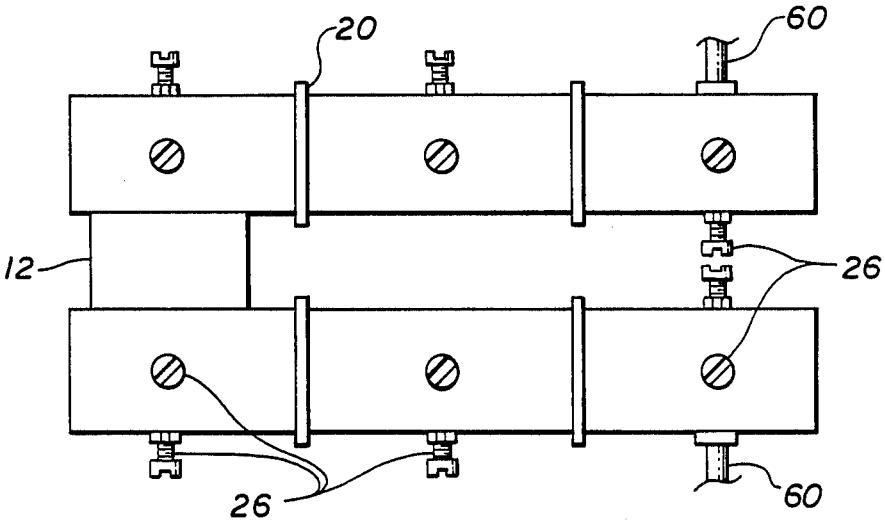
FIG. 8 shows an end view of the mutiplexer configuration of FIG. 7.

FIG. 7 illustrates the manifold length reduction made possible by the probe coupled teaching of the present invention. While the filter arrangement is illustrative, it should be noted that more filters may be mounted on a shorter manifold than that required under the teaching of the related art. FIG. 8 shows the end view of the multiplexer 10 of FIG. 7.

In operation, referring now to FIGS. 4–7, the inputs (or outputs) are provided to the filters 14, 16, 18, 20, 22, and 52 via input probes 60. Microwave energy at the resonant frequency of each filter is conducted by a probe 15 from the filter cavity 31 to the manifold waveguide 30. Energy propagating in the direction of the shorted end of manifold 29 is reflected back toward and ultimately out the open end 27 of manifold 12.

While the present invention has been described herein with reference to an illustrative embodiment and a particular application, it is understood that the invention is not limited thereto. Those having ordinary skill in the art and access to the teachings of the present invention will recognize additional modifications and applications within the scope thereof.

For example, the present invention is not limited to multiplexers. Instead, it may be used wherever it is desired communicate between waveguides while minimizing the spacing therebetween, eg., microwave distributors, couplers, diplexers and etc. In addition, the present invention allows for a variety of system configurations by which waveguides are coupled. It should also be noted that energy can also propagate in the reverse direction from that described above. That is, the manifold end 27 can be the input and coaxial connectors 60 the output. Simultaneous transmit and receive functions can be performed by the mutiplexer 10 if desired.

It is therefore intended by the appended Claims to cover any and all such modifications, applications and embodiments. Accordingly,

What is claimed is:

1. A probe coupled waveguide multiplexer comprising:

a waveguide manifold having a longitudinal axis along the length thereof, a transverse axis thereacross, a top wall, a bottom wall, and first and second side walls providing an elongate cavity therebetween, along said longitudinal axis, for the propagation of electromagnetic energy and first and second waveguide filters, probe coupled to said manifold on opposite sides thereof on said top and bottom walls respectively, said first and second filters being mounted in a first plane parallel to said transverse axis and normal to said longitudinal axis of said manifold.

2. The probe coupled waveguide multiplexer of claim 1 including third and fourth waveguide filters, probe coupled to said manifold on opposite sides thereof on said top and bottom walls respectively, said third and fourth filters being mounted in a second plane parallel to said first plane and normal to said longitudinal axis, said third filter being adjacent to said first filter and said fourth filter being adjacent to said second filter.

* * * * *